US008150291B2

(12) United States Patent
Kouno

(10) Patent No.: US 8,150,291 B2
(45) Date of Patent: Apr. 3, 2012

(54) POWER MANAGEMENT SYSTEM, POWER MANAGEMENT METHOD AND COMPUTER READABLE MEDIUM STORING PROGRAM, ALLOWING POWER MANAGEMENT OF A PLURALITY OF IMAGE FORMING APPARATUSES

(75) Inventor: Takahiro Kouno, Amagasaki (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 1036 days.

(21) Appl. No.: 12/061,484

(22) Filed: Apr. 2, 2008

(65) Prior Publication Data

US 2009/0142089 A1 Jun. 4, 2009

(30) Foreign Application Priority Data

Dec. 4, 2007 (JP) ..... 2007-313280

(51) Int. Cl.
*G03G 21/02* (2006.01)
*G03G 15/00* (2006.01)

(52) U.S. Cl. ..... 399/79; 399/24

(58) Field of Classification Search ..... 399/79, 399/88, 24

See application file for complete search history.

(56) References Cited

FOREIGN PATENT DOCUMENTS

| | | |
|---|---|---|
| JP | 10-157252 | 6/1998 |
| JP | 11-203092 | 7/1999 |
| JP | 2002-351647 (A) | 12/2002 |
| JP | 2004-013203 (A) | 1/2004 |
| JP | 2006-340223 | 12/2006 |

OTHER PUBLICATIONS

JP10-157252 Machine translation.*
JP2004-013203 Machine translation.*
Notice of Grounds of Rejection issued in corresponding Japanese Application No. 2007-313280 dated Oct. 27, 2009, and an English Translation thereof.

* cited by examiner

*Primary Examiner* — David Gray
*Assistant Examiner* — Andrew Do
(74) *Attorney, Agent, or Firm* — Buchanan Ingersoll & Rooney PC

(57) ABSTRACT

When there are a plurality of candidate image forming apparatuses that are to be turned ON, a CPU refers to an MFP wearout degree table and obtains wearout degree of each candidate. Then, the CPU determines whether there is any candidate of which wearout degree is lower than a prescribed lower threshold value or not. If there is a candidate of which wearout degree is lower than the prescribed lower threshold value, the CPU determines the image forming apparatus as the object to be powered ON.

9 Claims, 11 Drawing Sheets

FIG.8

272

| 272a USER ID | 272b USER NAME | 272c PASSWORD |
|---|---|---|
| 001 | USER 1 | *** |
| 002 | USER 2 | *** |
| 003 | USER 3 | *** |
| ⁓ | ⁓ | ⁓ |

FIG.9

274

| | USER 1 | USER 2 | USER 3 |
|---|---|---|---|
| ACCUMULATED LOG IN TIME | 300(h) | 270(h) | 100(h) |

FIG.10

276

| 276a TIME POINT | 276b USER ID | 276c MFP | 276d JOB CONTENTS |
|---|---|---|---|
| 10/1 10:10 | USER 1 | MFP1 | MONOCHROME COPY, 50 SHEETS |
| 10/1 10:30 | USER 1 | MFP1 | FACSIMILE TRANSMISSION, 20 SHEETS |
| 10/1 10:40 | USER 3 | MFP2 | COLOR COPY, 10 SHEETS |
| 10/1 11:05 | USER 2 | MFP1 | COLOR COPY, 5 SHEETS |
| ⁓ | ⁓ | ⁓ | ⁓ |

FIG.11

278

| | | USER 1 | USER 2 | USER 3 |
|---|---|---|---|---|
| 278a | FUNCTION 1 | 500 SHEETS (79%) | 100 SHEETS (32%) | 30 SHEETS (23%) |
| 278b | FUNCTION 2 | 30 SHEETS (5%) | 200 SHEETS (65%) | 10 SHEETS (8%) |
| 278c | FUNCTION 3 | 100 SHEETS (16%) | 0 SHEET (0%) | 40 SHEETS (31%) |
| 278d | FUNCTION 4 | 0 SHEET (0%) | 10 SHEETS (3%) | 50 SHEETS (48%) |

FIG.12

280

| | | MFP1 | MFP2 | MFP3 |
|---|---|---|---|---|
| 280a | UNIT 1 | 80% | 60% | – |
| 280b | UNIT 2 | 20% | 50% | – |
| 280c | UNIT 3 | 10% | 30% | 30% |

FIG.13

282

| | | MFP1 | MFP2 | MFP3 |
|---|---|---|---|---|
| 282a | FUNCTION 1 | Y (40 SHEETS/MIN.) | Y (60 SHEETS/MIN.) | N |
| 282b | FUNCTION 2 | Y (20 SHEETS/MIN.) | Y (100 SHEETS/MIN.) | N |
| 282c | FUNCTION 3 | Y (15 SHEETS/MIN.) | N | Y (30 SHEETS/MIN.) |
| 282d | FUNCTION 4 | Y (50 SHEETS/MIN.) | Y (30 SHEETS/MIN.) | Y (60 SHEETS/MIN.) |

FIG.14

284

| | MFP1 | MFP2 | MFP3 |
|---|---|---|---|
| POWER STATE | ON | ON | OFF |

POWER MANAGEMENT SYSTEM, POWER MANAGEMENT METHOD AND COMPUTER READABLE MEDIUM STORING PROGRAM, ALLOWING POWER MANAGEMENT OF A PLURALITY OF IMAGE FORMING APPARATUSES

This application is based on Japanese Patent Application No. 2007-313280 filed with the Japan Patent Office on Dec. 4, 2007, the entire content of which is hereby incorporated by reference.

BACKGROUND OF THE INVENTION

1. Field of the Invention

The present invention relates to a power management system, a power management method and a computer readable medium storing a program, allowing power management of a plurality of image forming apparatuses and, more specifically, to a scheme for power management considering degree of wearout among image forming apparatuses.

2. Description of the Related Art

With growing awareness of environmental issues, approaches have been made to reduce power consumption of various electric appliances. Such approaches are also made in the field of office equipment represented by an image forming apparatus.

It is often the case in an office to have a plurality of image forming apparatuses connected to a network including a plurality of personal computers. Schemes to reduce power consumption in such a system of network configuration have been proposed.

By way of example, Japanese Laid-Open Patent Publication No. 2002-351647 discloses a configuration in an image forming apparatus having a network function allowing connection to a plurality of external devices, for managing period setting before entering a sleep mode, depending on states of external devices connected to the network. Further, Japanese Laid-Open Patent Publication No. 2004-013203 discloses a network system optimally managing device power sources by estimating frequency of use of devices (image forming apparatuses) based on the number of boot-ups/accesses of clients under control of a server, in a network environment.

In the network system disclosed in Japanese Laid-Open Patent Publication No. 2004-013203, the server detects connected clients and assumes the number/type of necessary image forming apparatuses based on the total number of detected clients, and thereby selects an image forming apparatus from a group of image forming apparatuses controlled by the server and turns the power of the selected image forming apparatus ON or OFF.

In the network system, however, the image forming apparatus is selected based only on the past printing results of clients and a function table of image forming apparatuses and, therefore, frequency of selecting a specific image forming apparatus (for example, an image forming apparatus set at a higher position in the function table) comes to be relatively high, and operating ratio of the apparatus becomes higher than other apparatuses. As a result, degree of wearout varies among the group of image forming apparatuses.

If a specific image forming apparatus comes to have higher degree of wearout as described above, product life of the apparatus would be shorter than other apparatuses. As a result, efficient maintenance and management of the group of image forming apparatuses would be hindered, and required cost would be increased.

SUMMARY OF THE INVENTION

The present invention was made to solve such a problem, and its object is to provide a power management system, power management method and a computer readable medium storing power management program efficiently reducing total power consumption of a plurality of image forming apparatuses and allowing efficient maintenance and management of the plurality of image forming apparatuses.

According to an aspect, the present invention provides a power management system for managing power of a plurality of image forming apparatuses. The power management system includes: a plurality of user terminals used by users of the plurality of image forming apparatuses; a detecting portion for detecting increase or decrease of the number of user terminals that are being used among the plurality of user terminals; a first determining portion for determining whether a change of power state of any of the image forming apparatuses is necessary or not, when the number of user terminals that are being used increased or decreased; a second determining portion for determining an object image forming apparatus, when change of power state is determined to be necessary; a changing portion for changing the power state of the object image forming apparatus; and a wearout degree obtaining portion for obtaining wearout degree of each of the image forming apparatuses, based on operation history of the plurality of image forming apparatuses. The second determining portion determines the object image forming apparatus such that the plurality of image forming apparatuses come to have balanced wearout degree, based on the wearout degree.

Preferably, the second determining portion includes a part for extracting candidate image forming apparatuses of which power state is to be changed, in response to increase or decrease of the number of user terminals that are being used, and a part for determining as the object image forming apparatus, that one of the candidate image forming apparatuses of which wearout degree satisfies a prescribed condition.

More preferably, the second determining portion further includes a part for calculating, when none of the candidate image forming apparatuses has the wearout degree satisfying the prescribed condition, priority based on the wearout degree of each of the image forming apparatuses, and for determining the image forming apparatus having the highest priority to be the object image forming apparatus.

Preferably, the detecting portion identifies users using the plurality of user terminals. The system further includes a use history obtaining portion for obtaining user-by-user use history based on operation history of the plurality of image forming apparatuses. The first determining portion includes a part for calculating expected demanded capacity based on the use history of users corresponding to the user terminals that are being used, and a part for comparing actual capacities of the image forming apparatuses that are powered on with the expected demanded capacity.

Preferably, the wearout degree includes an index of at least one of an imaging unit, a toner unit and an image reading unit.

According to another aspect, the present invention provides a power management method of managing power of a plurality of image forming apparatuses. The power management method includes the steps of: detecting increase or decrease of the number of user terminals that are being used, among a plurality of user terminals used by users of the plurality of image forming apparatuses, determining, when the number of user terminals that are being used increased or decreased, whether change of power state of any of the image forming apparatuses is necessary or not, when the change of power state is determined to be necessary, determining an object image forming apparatus; changing the power state of the object image forming apparatus, and obtaining wearout degree of each image forming apparatus, based on operation history of the plurality of image forming apparatuses. The determining the object image forming apparatus step includes the step of determining the object image forming apparatus such that the plurality of image forming apparatuses come to have balanced wearout degree, based on the wearout degree.

Preferably, the determining the object image forming apparatus step includes the steps of extracting candidate image forming apparatuses of which power state is to be changed, in response to increase or decrease of the number of user terminals that are being used, and determining that one of the candidate image forming apparatuses of which wearout degree satisfies a prescribed condition to be the object image forming apparatus.

More preferably, the determining the object image forming apparatus step further includes the step of calculating, when none of the candidate image forming apparatuses has the wearout degree satisfying the prescribed condition, priority based on the wearout degree of each of the image forming apparatuses, and determining the image forming apparatus having the highest priority to be the object image forming apparatus.

Preferably, the detecting step includes the step of identifying users using the plurality of user terminals. The method further includes the step of obtaining user-by-user use history based on operation history of the plurality of image forming apparatuses. The determining necessity of change of power state step includes the steps of calculating expected demanded capacity based on the use history of users corresponding to the user terminals that are being used, and comparing actual capacities of the image forming apparatuses that are powered on with the expected demanded capacity.

Preferably, the wearout degree includes an index of at least one of an imaging unit, a toner unit and an image reading unit.

According to a still further aspect, the present invention provides a computer readable medium storing a power management program for causing a computer to perform power management of a plurality of image forming apparatuses. The program causes the computer to execute the following steps of: detecting increase or decrease of the number of user terminals that are being used, among a plurality of user terminals used by users of the plurality of image forming apparatuses; determining, when the number of user terminals that are being used increased or decreased, whether change of power state of any of the image forming apparatuses is necessary or not; when the change of power state is determined to be necessary, determining an object image forming apparatus; changing the power state of the object image forming apparatus; and obtaining wearout degree of each image forming apparatus, based on operation history of the plurality of image forming apparatuses.

Preferably, the determining the object forming apparatus step includes the step of determining the object image forming apparatus such that the plurality of image forming apparatuses come to have balanced wearout degree, based on the wearout degree.

More preferably, the determining the object forming apparatus step includes the steps of extracting candidate image forming apparatuses of which power state is to be changed, in response to increase or decrease of the number of user terminals that are being used, and determining that one of the candidate image forming apparatuses of which wearout degree satisfies a prescribed condition to be the object image forming apparatus.

Preferably, the determining the object image forming apparatus step further includes the step of calculating, when none of the candidate image forming apparatuses has the wearout degree satisfying the prescribed condition, priority based on the wearout degree of each of the image forming apparatuses, and determining the image forming apparatus having the highest priority to be the object image forming apparatus Preferably, the detecting step includes the step of identifying users using the plurality of user terminals. The program further causes the computer to execute the step of obtaining user-by-user use history based on operation history of the plurality of image forming apparatuses. The determining necessity of change of power state step includes the steps of calculating expected demanded capacity based on the use history of users corresponding to the user terminals that are being used, and comparing actual capacities of the image forming apparatuses that are powered on and the expected demanded capacity.

Preferably, the wearout degree includes an index of at least one of an imaging unit, a toner unit and an image reading unit.

According to the present invention, total power consumption of a plurality of image forming apparatuses can efficiently be reduced and a plurality of image forming apparatuses can efficiently be maintained and managed.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 shows an example of a data structure stored in a user management table in the server in accordance with an embodiment of the present invention.

FIG. 9 shows an example of a data structure stored in a log-in time management table in the server in accordance with an embodiment of the present invention.

FIG. 10 shows an example of a data structure stored in an operation history table in the server in accordance with an embodiment of the present invention.

FIG. 11 shows an example of a data structure stored in a user use history table in the server in accordance with an embodiment of the present invention.

FIG. 12 shows an example of a data structure stored in an MFP wearout degree table in the server in accordance with an embodiment of the present invention.

FIG. 13 shows an example of a data structure stored in an MFP function table in the server in accordance with an embodiment of the present invention.

FIG. 14 shows an example of a data structure stored in an MFP power state table in the server in accordance with an embodiment of the present invention.

DESCRIPTION OF THE PREFERRED EMBODIMENTS

Figure 1:
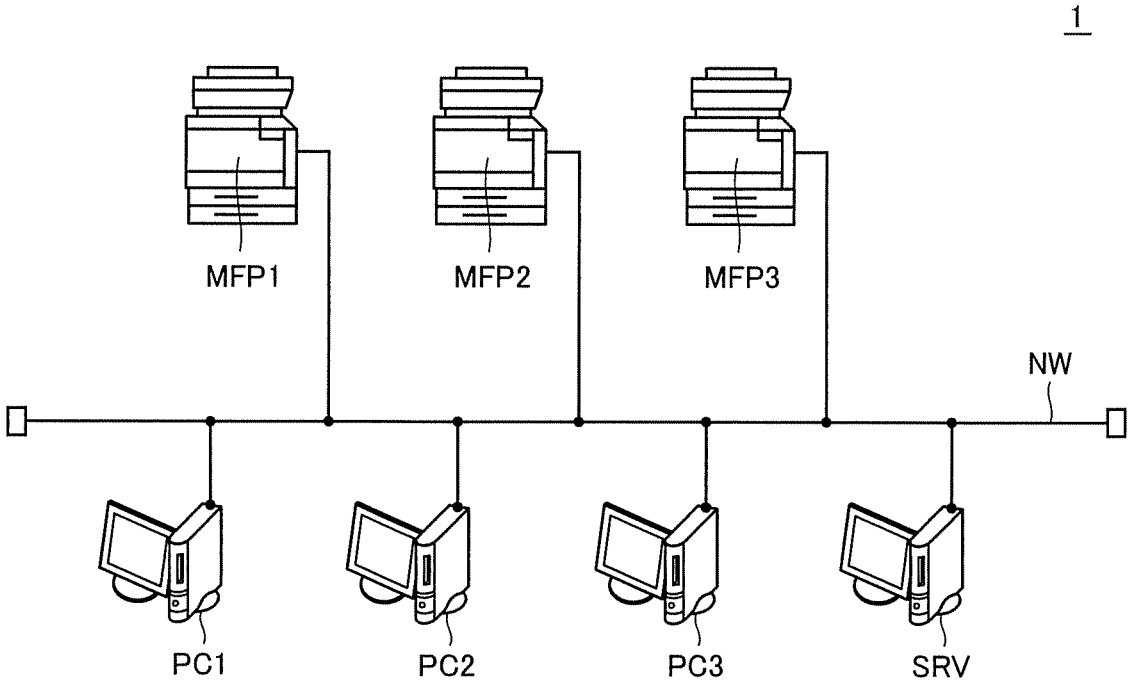
FIG. 1 shows a schematic configuration of a power management system in accordance with an embodiment of the present invention.

Embodiments of the present invention will be described in detail with reference to the figures. In the figures, the same or corresponding portions are denoted by the same reference characters and description thereof will not be repeated.

(Overall Configuration of Power Management System)

Referring to FIG. 1, a power management system 1 in accordance with an embodiment of the present invention includes a plurality of computers PC1, PC2 and PC3, a server SRV, and a plurality of image forming apparatuses MFP1, MFP2 and MFP3. In power management system 1 in accordance with the present embodiment, it is assumed that at least personal computers PC1, PC2 and PC3 and image forming apparatuses MFP1, MFP2 and MFP3 are placed in one same office and the users of personal computers PC1, PC2 and PC3 are also the users of image forming apparatuses MFP1, MFP2 and MFP3. It is noted that the power system in accordance with the present invention is not limited to such a configuration or numbers.

Personal computers PC1, PC2 and PC3, server SRV and image forming apparatuses MFP1, MFP2 and MFP3 are configured to allow data communication with each other. The network NW may be a private line such as LAN (Local Area Network) or WAN (Wide Area Network), or a public line such as virtual private network, which may be partially or fully implemented to realize wireless communication such as wireless LAN. The present invention is applicable to a configuration that allows data communication between personal computer PC1, PC2 or PC3 and server SRV and between the server SRV and image forming apparatus MFP1, MFP2 or MFP3, and therefore, independent networks may be formed to connect these components to each other.

Personal computers PC1, PC2 or PC3 (in the following, also generally referred to as a "personal computer PC") is typically a user terminal having a known operating system (OS) installed therein. Specifically, in personal computer PC, application program(s) including document creation and/or spreadsheet are installed, and the user creates a document or the like using such application program. When the user inputs a print request, print data generated from such document is transmitted from personal computer PC to image forming apparatus MFP1, MFP2 or MFP3.

Here, for the user to use personal computer PC, first, the user must log-in by operating the PC. Specifically, the user operates personal computer PC and inputs his/her user ID and, in most cases, his/her password. Then, the personal computer PC transmits the input user ID and the password to the server SRV, for authentication. If authentication by the server SRV succeeds, personal computer is set to a usable state. In response to a log-off of the user, personal computer PC transmits a log-off notice to the server SRV. Processes related to log-in and log-off as described above are well-known techniques for server-client systems and, therefore further details will not be described here.

Server SRV is a control apparatus mainly controlling power management of image forming apparatuses MFP1, MFP2 and MFP3. Specifically, server SRV executes, in addition to the authentication process described above, various control processes related to power management of image forming apparatuses MFP1, MFP2 and MFP3, as will be described later.

Image forming apparatuses MFP1, MFP2 and MFP3 (also generally referred to as an "image forming apparatus MFP") are typically a Multi Function Peripheral having a plurality of functions including a copying function (monochrome and/or color), a printer function, a facsimile transmission function and an image reading function. Particularly, the image forming apparatus MFP in accordance with the present embodiment executes, in response to a power instruction from server SRV, changing of power state, that is, switching between a power ON state (in which power is supplied) and a power OFF state (in which power supply is shut off).

Further, the image forming apparatus MFP in accordance with the present embodiment is configured to transmit operation result by the user to server SRV. Based on the operation result, server SRV calculates degree of wearout of each image forming apparatus MFP. Further, each image forming apparatus MFP requests input of user ID and a password at the time of use by the user, and transmits the operation result corresponding to the input user ID to the server SRV. Therefore, the server SRV can obtain user-by-user operation result of the image forming apparatus MFP, and based on the operation result, it can obtain expected capacity value demanded of the image forming apparatus MFP by each user (hereinafter also referred to as "expected demanded capacity").

Specifically, the server SRV detects increase or decrease of the number of personal computers PC that are logged-in by any user. When the number of personal computers PC in the log-in state increases or decreases, server SRV specifies the user who logged in to the personal computer PC and, in accordance with the expected demanded capacity of the user, determines whether an image forming apparatus MFP that has been power-OFF should be activated or an image forming apparatus that has been power-ON should be turned off. Further, if it is determined that power state of an image forming apparatus MFP should be changed, the server SRV determines which of the image forming apparatuses MFP should be set to the power ON state or power OFF state, based on the degree of wearout of each of the image forming apparatuses. More specifically, server SRV determines the object image forming apparatus MFP so that the degree of wearout among image forming apparatuses MFPs becomes balanced.

Figure 2A:
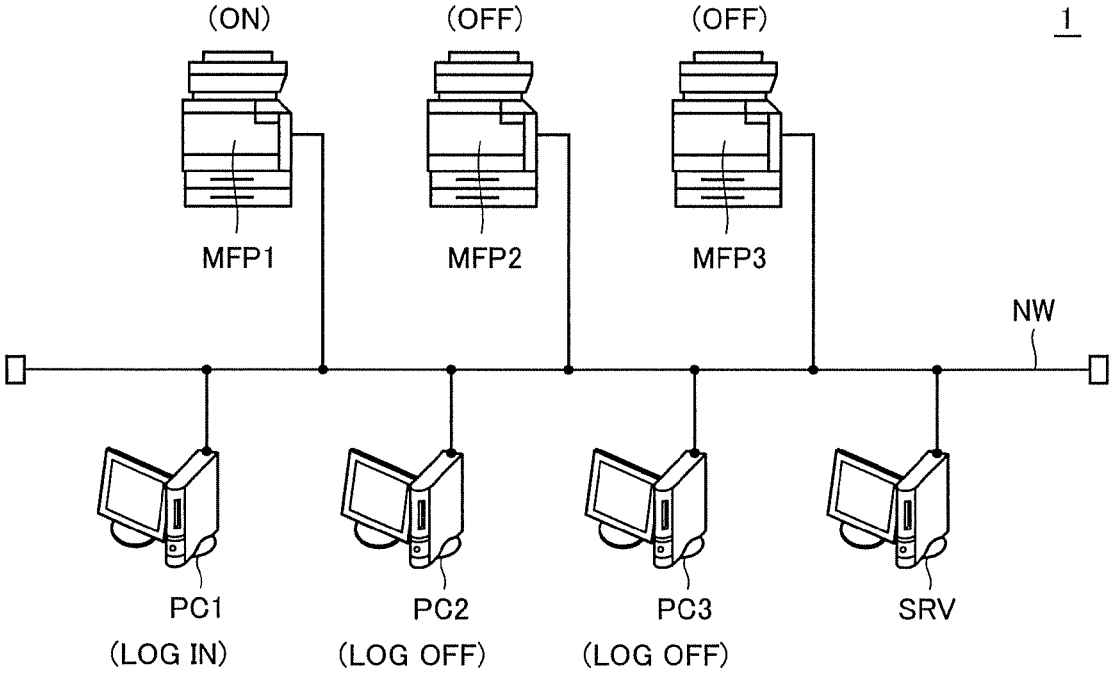
FIGS. 2A and 2B schematically illustrate an operation of the power management system in accordance with an embodiment of the present invention.
Figure 2B:
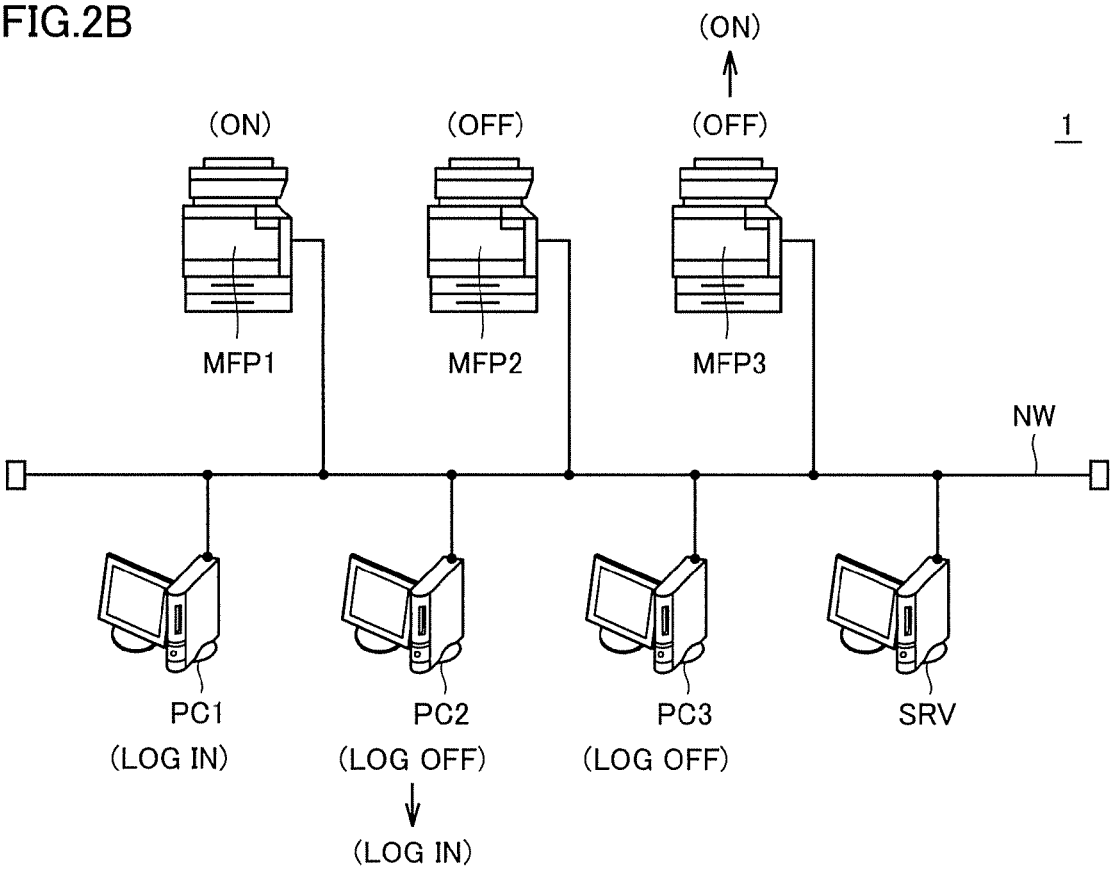

FIGS. 2A and 2B schematically illustrate an operation of the power management system in accordance with an embodiment of the present invention.

By way of example, assume that a user logged in to personal computer PC1, while no user has logged in to personal computer PC2 or PC3 (log-off state), as shown in FIG. 2A. Here, assume that image forming apparatus MFP1 is in the power-ON state and remaining image forming apparatuses MFP2 and MFP3 are in the power-OFF state.

Then, as shown in FIG. 2B, when any user logs in to personal computer PC2, server SRV determines, based on the expected demanded capacity by the user who logged in to the personal computer PC2, whether it is necessary to change image forming apparatus MFP2 or MFP3 from power-OFF to power-ON state or not. Further, if change of power state is determined to be necessary, server SRV determines the image forming apparatus which should be changed from power-OFF to power-ON, based on the degrees of wearout of image forming apparatuses MFP2 and MFP3. In the example shown in FIG. 2B, server SRV determines that power state of image forming apparatus MFP3 should be changed and, based on the determination, image forming apparatus MFP3 is changed from power-OFF to power-ON.

In the following, the scheme to realize such a function will be described in detail.

(Hardware Configuration of Image Forming Apparatus)

Figure 3:
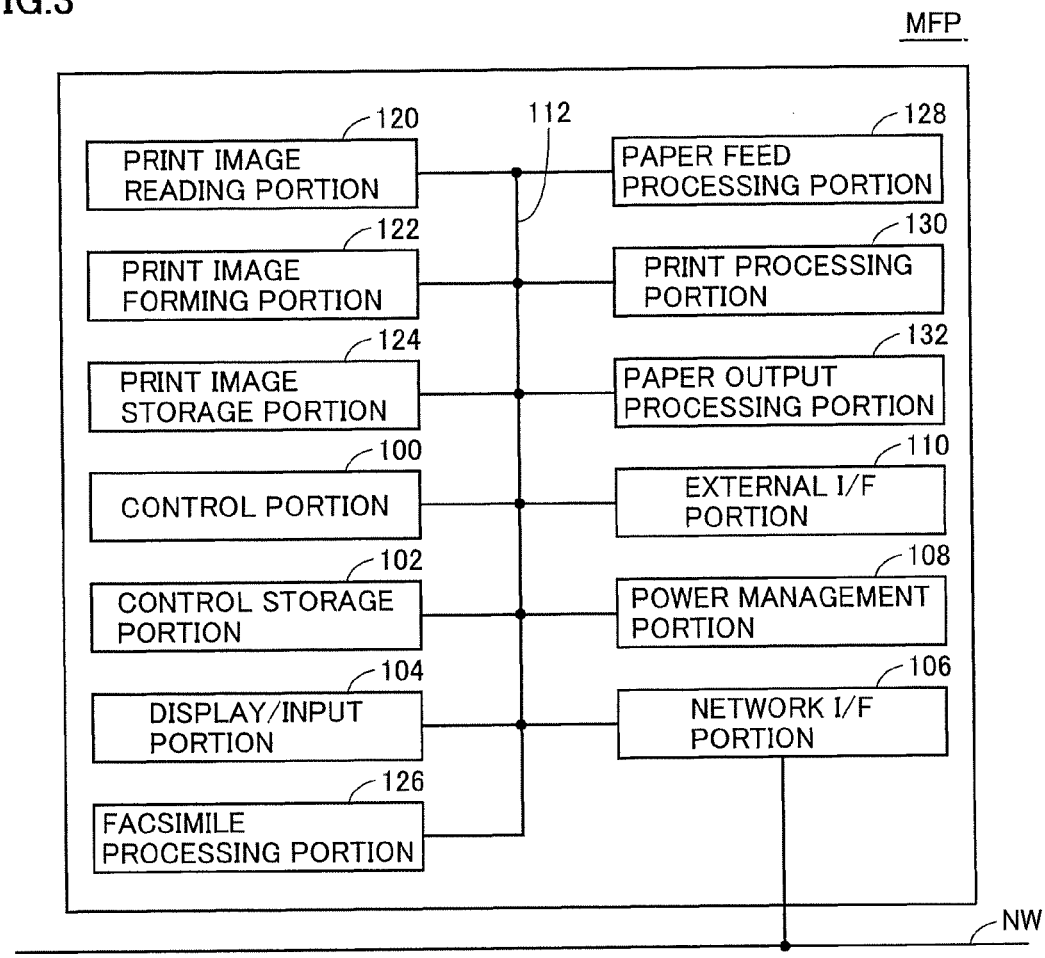
FIG. 3 is a schematic diagram showing a hardware configuration of the image forming apparatus in accordance with an embodiment of the present invention.

Referring to FIG. 3, the image forming apparatus MFP in accordance with an embodiment of the present invention includes a control portion 100, a control storage portion 102, a display/input portion 104, a network interface (I/F) portion 106, a power management portion 108, and an external interface (I/F) portion 110. These parts are control loads of relatively small power consumption. Further, image forming apparatus MFP includes a print image reading portion 120, a print image forming portion 122, a print image storage portion 124, a facsimile processing portion 126, a paper feed processing portion 128, a print processing portion 130, and a paper output processing portion 132. These parts correspond to print engine loads realizing various functions of the image forming apparatus MFP, of relatively large power consumption. These portions are connected to each other by a bus 112.

In the present specification, the "power OFF" state refers to a state in which power is not supplied to the print engine loads mentioned above. Specifically, in order to realize switching from "power OFF" to "power ON", even in the "power OFF" state, power is continuously supplied to the control loads mentioned above.

Control portion 100 is a part for overall control of the image forming apparatus MFP and formed to include a CPU (Central Processing Unit). Control portion 100 reads and executes programs stored in advance in control storage portion 102 and the like, to realize the processes in accordance with the present embodiment.

Display/input portion 104 is a device having a function of displaying various information displaying images and setting images to the user and a function of receiving an input operation by the user and, typically, it is formed by a liquid crystal panel having a touch panel mounted on its surface. As will be described later, when the user uses the image forming apparatus MFP, he/she inputs his/her user ID and a password by operating the display/input portion 104.

Network interface portion 106 is a part for data communication with server SRV or personal computer PC through the network NW.

Power management portion 108 is a part for managing power state of image forming apparatus MFP, and it switches the image forming apparatus to power-ON or power-OFF, in accordance with an instruction from control portion 100.

External interface portion 110 is a part for connection to a personal computer, a USB memory or the like.

Print image reading portion 120 is a part for realizing the image reading function, which scans a document and forms image data. Typically, print image reading portion 120 includes a loading tray for setting a document, a platen glass, a feeder portion for automatically feeding the document set on the loading tray to platen glass one by one, and an output tray for outputting read document (none shown in the figure).

Print image forming portion 122 performs a prescribed image processing on the image data read by print image reading portion 120 or on print data transmitted from personal computer PC, and forms data suitable for printing. Typically, if the image forming apparatus MFP supports color processing, print image forming portion 122 converts the image data or the print data to raster data of four colors, that is, yellow (Y), magenta (M), cyan (C) and black (K), and outputs the raster data of respective colors to printing portion 116.

Print image storage portion 124 temporarily stores the data formed by print image forming portion 122, and successively outputs the data to print processing portion 130.

Facsimile processing portion 126 is a part for realizing the facsimile function, and it transmits image data read by print image reading portion 120 to a user-designated address, through a telephone line (not shown).

Paper feed processing portion 128 feeds sheets of paper stored beforehand in a paper tray, not shown, to print processing portion 130, when the image forming apparatus MFP functions as a copy machine or a printer.

Print processing portion 130 is a part for performing the print process of printing an image to a sheet of paper. Typically, it includes a toner unit for supplying toner, an imaging unit including an exposurer and a development roller, a transfer roller for transferring the toner image formed by the imaging unit to a paper medium, a fixer for fixing the transferred toner image, and a control circuit controlling operations of these portions.

Paper output processing portion 132 is a part for performing processes related to output of paper on which print process has been done by print processing portion 130 and, typically, it executes processes of "sort", "group", "staple" and "punch".

(Hardware Configuration of Personal Computer and Server)

Figure 4:
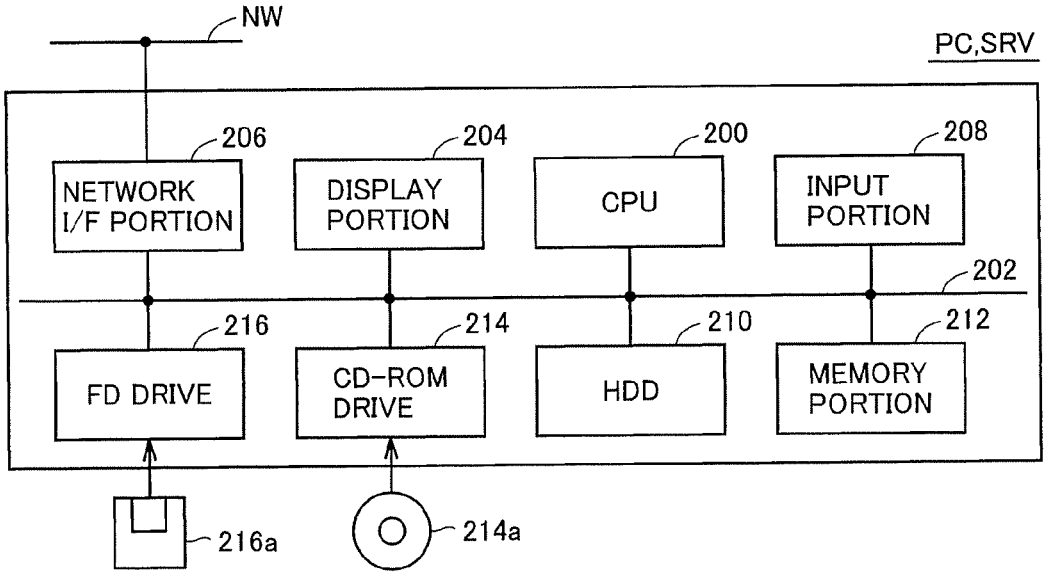
FIG. 4 is a schematic diagram showing a hardware configuration of a personal computer in accordance with an embodiment of the present invention.

Referring to FIG. 4, personal computer PC in accordance with the embodiment of the present invention includes a CPU 200 executing various programs including the operating system, a memory portion 212 temporarily storing data necessary for CPU 200 to execute the programs, and a hard disk portion 210 storing the programs executed by CPU 200 in a non-volatile manner. Such a program is read by a CD-ROM (Compact Disk-Read Only Memory) drive 214 or a flexible disk (FD) drive 216, from a CD-ROM 214*a* or a flexible disk 216*a*, respectively.

CPU 200 receives an operation request from the user through an input portion 208 implemented by a keyboard and/or a mouse, and provides a screen image output generated by execution of a program to display portion 204. Further, CPU 200 performs data communication with server SRV or image forming apparatus MFP through network interface (I/F) portion 206 provided by an LAN card or the like. These parts are connected to each other through an internal bus 202.

The hardware configuration of server SRV is basically similar to that shown in FIG. 4 and, therefore, detailed description will not be repeated.

(Functional Configuration and Process Procedure of Image Forming Apparatus)

Figure 5:
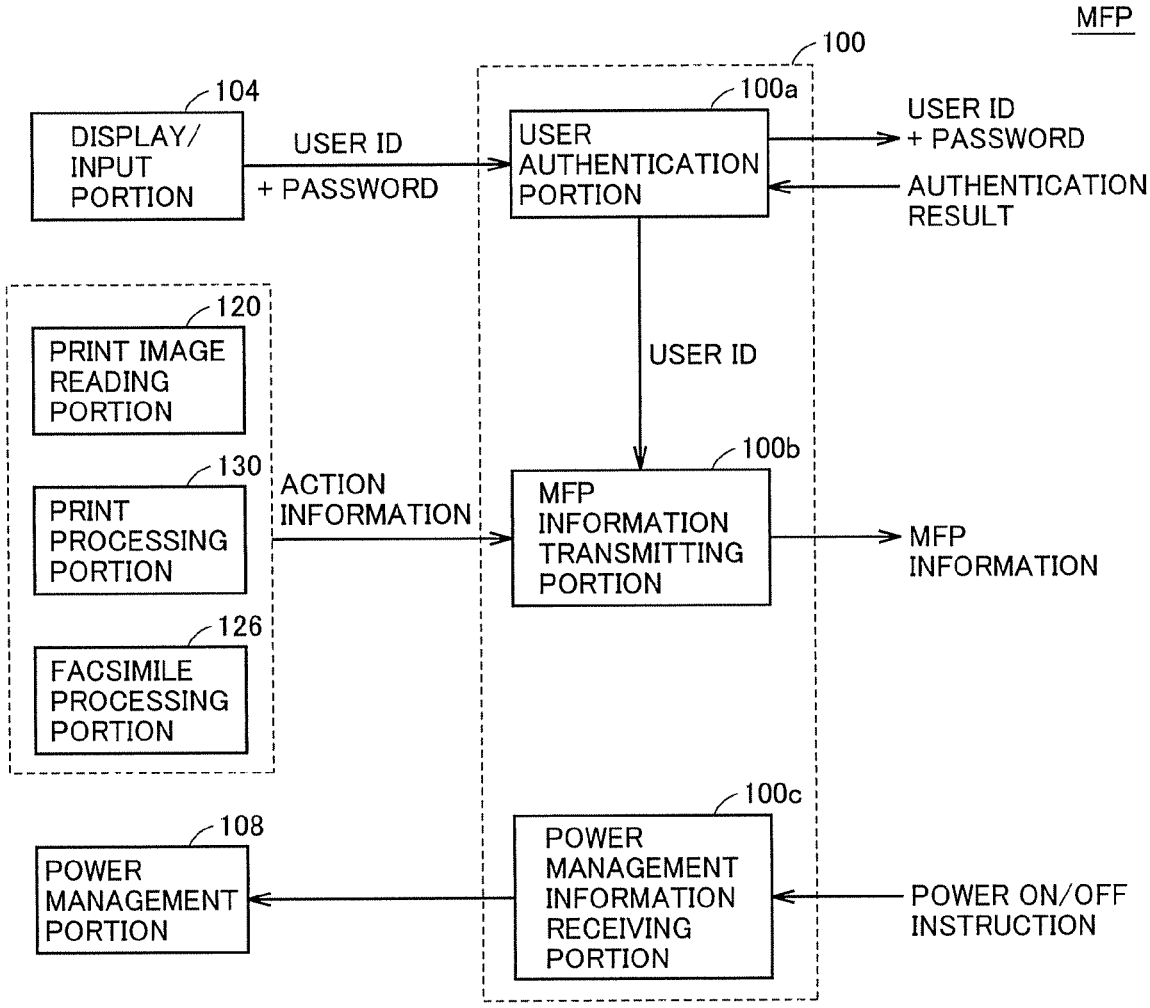
FIG. 5 is a block diagram representing functional configuration of an image forming apparatus in accordance with an embodiment of the present invention.

Referring to FIG. 5, control portion 100 of the image forming apparatus MFP in accordance with the embodiment of the present invention includes, as its functions, a user authentication portion 100*a* and an MFP information transmitting portion 100*b*.

User authentication portion 100*a* is a part for authenticating and identifying a user who uses the image forming apparatus MFP. Specifically, user authentication portion 100*a* transmits the user ID and the password input by the user through an operation of display/input portion 104 to server SRV, and receives a result of authentication from server SRV, as will be described later. When the user authentication process of the user ID succeeds, user authentication portion 100*a* sets the image forming apparatus MFP to an operation permitted state. At the same time, user authentication portion 100*a* outputs the user ID that has been successfully authenticated, to MFP information transmitting portion 100*b*.

User authentication portion 100*a* performs the authentication process for the user who directly operates and uses the image forming apparatus MFP and does not perform the authentication process on the print data transmitted from personal computer PC. The reason for this is that the user of personal computer PC has already been subjected to the user authentication process before the use of PC and repeated user authentication is unnecessary. Further, the print data transmitted from personal computer PC includes information (for example, header information) for identifying the transmission source. When the print data is received, user authentication portion 100*a* may ask the server SRV for the user ID corresponding to the personal computer PC as the transmission source of the print data and may output the user ID to MFP information transmitting portion 100*b*. In this manner, user authentication portion 100*a* identifies the user who directly or indirectly uses the image forming apparatus MFP, and outputs the user ID to MFP information transmitting portion 100*b*.

MFP information transmitting portion 100*b* transmits the operation result of the image forming apparatus MFP (MFP information) to server SRV. Specifically, MFP information transmitting portion 110*b* obtains operation result such as the used function and number of sheets (or times) based on action information of print image reading portion 120, print processing portion 130, facsimile processing portion 126 and the like. Then, MFP information transmitting portion 100*b* adds, to the operation result, the user ID from user authentication portion 100*a* and an ID representing itself, to generate a piece of MFP information, and transmits the MFP information to server SRV.

Figure 6:
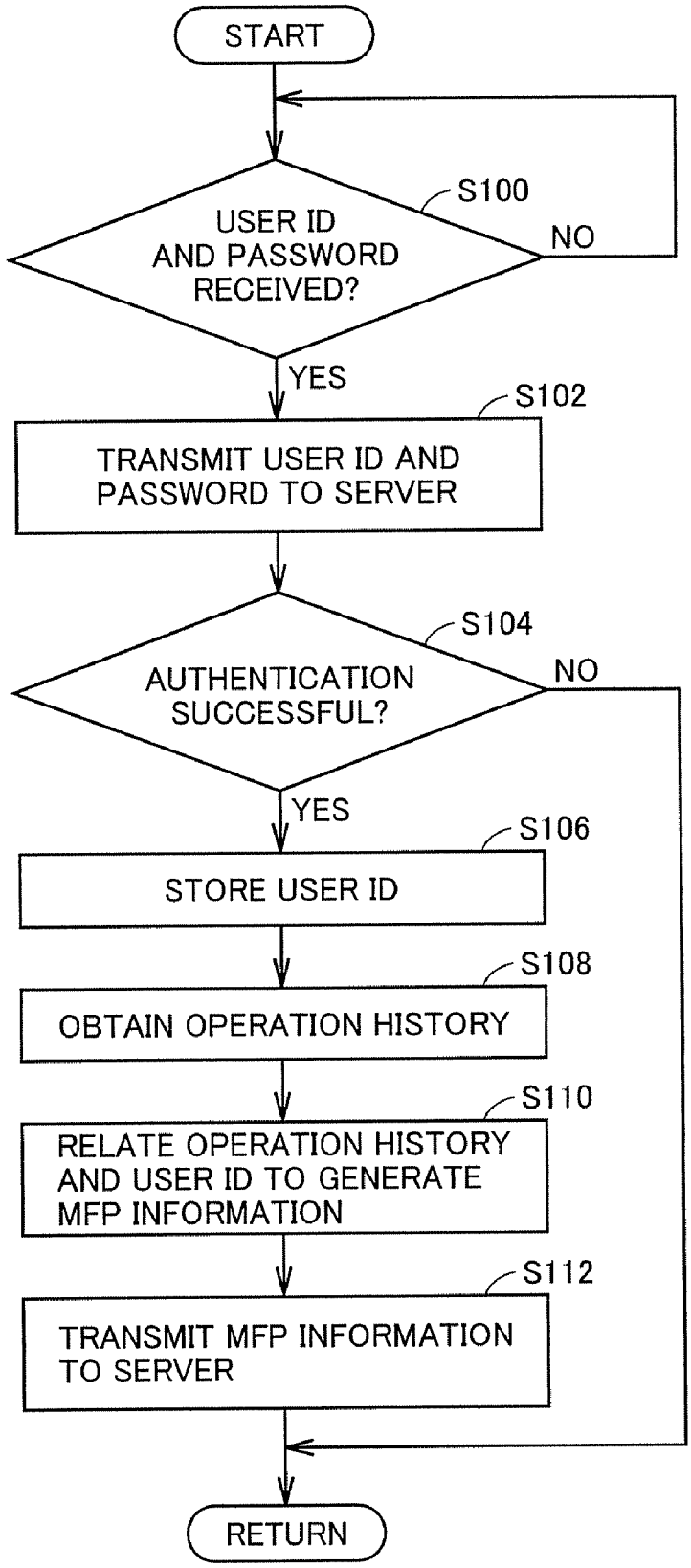
FIG. 6 is a flowchart representing process procedure related to user authentication and MFP information transmission in the image forming apparatus in accordance with an embodiment of the present invention.

FIG. 6 shows process procedure related to user authentication and MFP information transmission at the image forming apparatus MFP in accordance with the embodiment of the present invention.

Referring to FIGS. 5 and 6, first, control portion 100 functioning as user authentication portion 100*a* determines whether the user ID and the password have been received from display/input portion 104 (step S100). If the user ID and the password have not been received from display/input portion 104 (NO at step S100), the process following step S100 is repeated after a prescribed period.

If the user ID and the password are received from display/input portion 104 (YES at step S100), control portion 100 functioning as user authentication portion 100*a* transmits the user ID and the password to the server SRV (step S102), and waits for reception of authentication result from server SRV. Then, control portion 100 functioning as user authentication portion 100*a* determines whether the authentication procedure has been successful or not (step S104). If the authentication procedure fails (NO at step S104), the process returns to the start.

If the authentication process has been successful (YES at step S104), the input user ID is temporarily stored (step S106). Then, control portion 100 functioning as MFP information transmitting portion 100*b* obtains the operation result based on the action information of print image reading portion 120, print processing portion 130, facsimile processing portion 126 and the like (step S108). Print image reading portion 120, print processing portion 130, facsimile processing portion 136 and the like execute prescribed jobs in accordance with the user operation.

When use of the image forming apparatus MFP by the user ends, control portion 100 functioning as MFP information transmitting portion 100*b* establishes correspondence between the obtained operation result with the user ID stored at step S106 to generate the MFP information (step S110), and transmits the MFP information to server SRV (step S112). Then, the process returns to the start. End of use of image forming apparatus MFP by the user typically refers to a completion of one job.

The user authentication and MFP information transmission in image forming apparatus MFP are executed in the above-described manner.

Again referring to FIG. 5, control portion 100 of image forming apparatus MFP further includes, as its function, a power management information receiving portion 100*c*. Power management information receiving portion 100*c* issues an instruction to power management portion 108 in accordance with a power ON/OFF instruction (which will be described later) from server SRV, to switch the power state of image forming apparatus MFP to power ON or power OFF.

(Functional Configuration and Process Procedure of Server)

Figure 7:
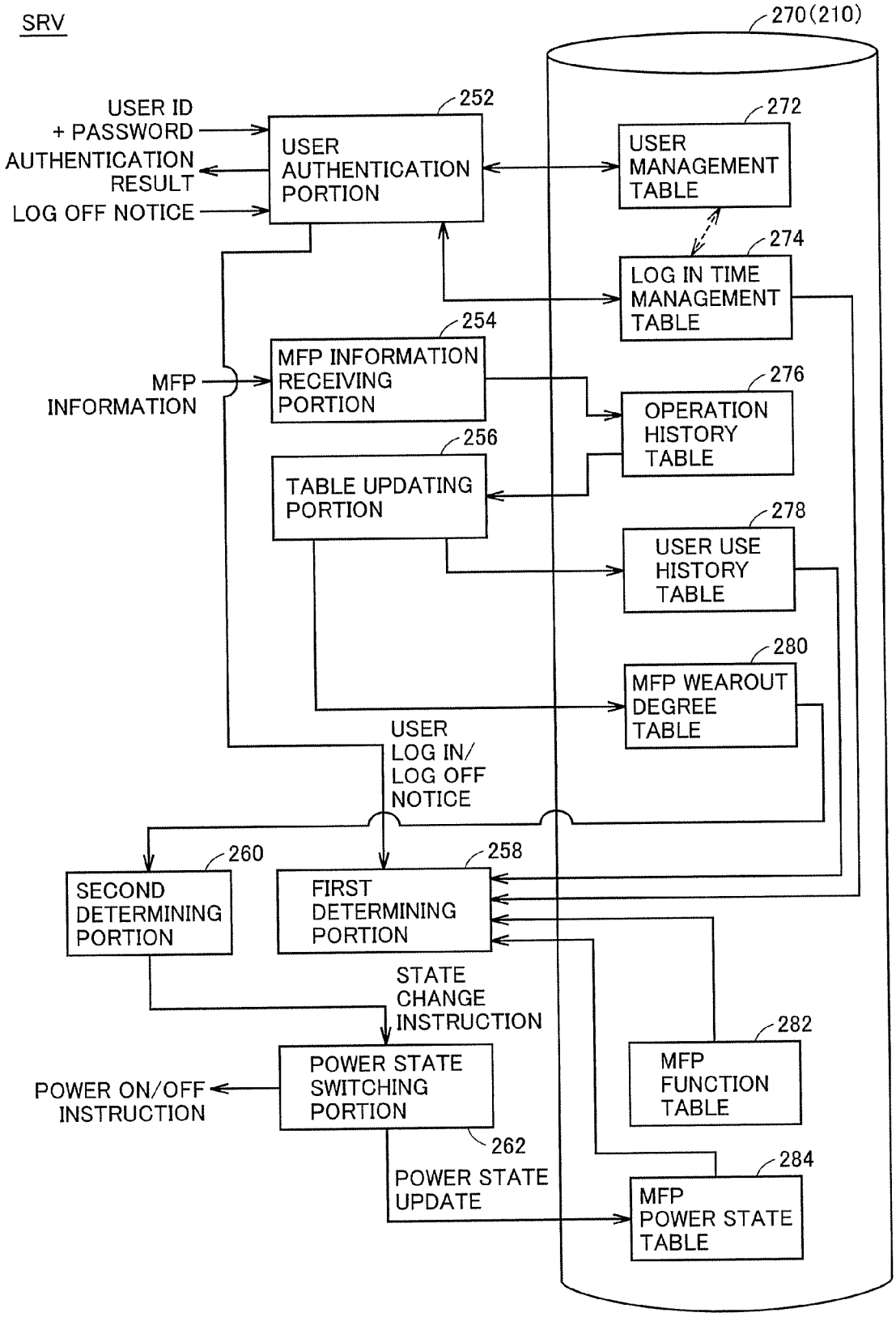
FIG. 7 is a block diagram representing functional configuration of a server in accordance with an embodiment of the present invention.

Referring to FIG. 7, server SRV in accordance with the embodiment of the present invention includes a user authentication portion 252, an MFP information receiving portion 254, a table updating portion 256, a first determining portion 258, a second determining portion 260, and a power state switching portion 262, as its functions. These functions are realized by CPU 200 reading programs stored in advance in hard disk portion 210 and the like to memory portion 212 and executing the same.

Further, server SRV includes a table storage portion 270 formed at a prescribed area of hard disk portion 210. Table storage portion 270 stores a user management table 272, a log-in time management table 274, an operation history table 276, a user use history table 278, an MFP wearout degree table 280, an MFP function table 282, and an MFP power state table 284.

User authentication portion 252 executes the authentication procedure on the user ID and the password transmitted from personal computer PC or image forming apparatus MFP. Specifically, user authentication portion 252 refers to user management table 272 stored in advance in table storage portion 270 to determine whether the password corresponding to the received user ID matches the received password, and if these match, provides an authentication result of success in response, and if not, provides an authentication result of failure in response.

Referring to FIG. 8, user management table 272 has a table structure including three fields 272*a*, 272*b* and 272*c*. Specifically, in field 272*a* of each record, a user ID is stored, in field 272*b*, a corresponding user name is stored, and in field 272*c*, a corresponding password is stored.

Again referring to FIG. 7, user authentication portion 252 detects user log-in to the personal computer PC through the authentication procedure, and detects log-off of the user from the personal computer PC by the log-off notice transmitted from the personal computer, as described above. Specifically, user authentication portion 252 identifies the user using personal compute PC and detects increase or decrease of the number of personal computers that are being used (logged-in) among the plurality of personal computers. If a user log-in or log-off to/from any of the personal computers PC is detected, user authentication portion 252 outputs a user log-in/log-off notice to first determining portion 258.

Further, in response to detection of a user logged-in to the personal computer PC or a user logged-off from the personal computer PC, user authentication portion 252 calculates an accumulated log-in time user by user. Specifically, user authentication portion 252 calculates, user by user, the period from log-in to log-off of any of the personal computers PC, and adds the accumulated time to log-in time management table 274.

FIG. 9 shows an example of a data structure stored in log-in time management table 274 of the server SRV in accordance with the embodiment of the present invention. Log-in time management table 274 is related to user management table 272, so that the user name is obtained.

Referring to FIG. 9, in log-in time management table 274, accumulated log-in time within a prescribed period is stored user by user. The prescribed period is determined to match the period of operation history stored in operation history table 276, which will be described later. The prescribed period is determined, for example, to be "one month before the present time".

The log-in time stored in log-in time management table 274 approximately corresponds to the working hours of each user. Specifically, it is often the case at an office that each user logs-in to a personal computer as a preparation to start his/her work and the personal computer is kept logged-in until the user goes home. Therefore, the log-in time means the time period in which the user stays at the office, that is, the time period in which the image forming apparatus MFP should be ready. The log-in time will be used as a reference time to calculate the expected demanded capacity for each user, as will be described later.

Again referring to FIG. 7, MFP information receiving portion 254 receives the MFP information transmitted from each image forming apparatus MFP and stores data contained therein successively in operation history table 276. More specifically, MFP information receiving portion 254 stores the operation result included in the MFP information in operation history table 276, together with the received time point, user ID, and information of reception source.

Referring to FIG. 10, operation history table 276 has a table structure including four fields 276*a*, 276*b*, 276*c* and 276*d*. Specifically, for each record, in field 276*a*, time point is stored, in field 276*b*, a corresponding user ID is stored, in field 276*c*, an ID of the image forming apparatus MFP as the corresponding transmission source is stored, and in field 276*d*, corresponding job contents are stored. Job contents stored in field 276*d* include the function used in the image forming apparatus MFP as the transmission source and the number of sheets (times), such as "monochrome copy, 50 sheets" or "facsimile transmission, 20 sheets".

Again referring to FIG. 7, table updating portion 256 collects, user-by-user and function-by-function, operation results successively stored in operation history table 276, and obtains the user use history in the prescribed period mentioned above. More specifically, table updating portion 256 extracts, from the operation history table 276 shown in FIG. 10, records having the same value in field 276*b*, and based on the data stored in field 276*d* of each extracted record, accumulates the number of sheets (times) for each function. By way of example, in operation history table 276 shown in FIG. 10, there are two records having field 276*b* of "user 1", and the data in field 276*d* of these records are "monochrome copy, 50 sheets" and "facsimile transmission, 20 sheets", respectively. Therefore, table updating portion 256 updates the values for "user 1" stored in user use history table 278 accordingly. Specifically, the use history of "monochrome copy" function is updated to a value by adding "50", and the use history of "facsimile transmission" function to a value by adding "20".

Referring to FIG. 11, user use history table 278 has a table structure including four records 278*a*, 278*b*, 278*c* and 278*d* for each user. In records 278*a*, 278*b*, 278*c* and 278*d*, use histories of functions 1 to 4 of image forming apparatus MFP are stored. For instance, for "user 1", use histories of functions 1 to 4 are "500 ", "30 ", "100" and "0", respectively Here, by way of example, the functions 1 to 4 correspond to "monochrome copy function," "color copy function," "facsimile transmission function" and "image reading function," respectively.

In this manner, user use history table 278 obtains and stores user-by-user use history in the prescribed period described above. In user use history table 278, relative ratio of used functions may be calculated user by user. Such ratios are given in parenthesis in FIG. 11. By making a reference to such a ratio, it is possible to identify a function that is used relatively frequently by each user, Again referring to FIG. 7, table updating portion 256 further collects, function-by-function for each image forming apparatus MFP, the operation results successively stored in operation history table 276 and obtains wearout degree of the image forming apparatus MFP. More specifically, table updating portion 256 extracts records having the same value in field 276*c*, accumulates number of sheets of actual result (times) part-by-part of each image forming apparatus MFP based on the data stored in field 276*d* of the extracted records, and normalizes the accumulated value by dividing a corresponding nominal action time. Here, "part-by-part" means unit by unit, such as "imaging unit", "toner unit" and "image reading unit" forming the image forming apparatus MFP.

For instance, in user history table 276 shown in FIG. 10, there are three records of which field 276*c* is "MFP1". Data in field 276*d* of these records are "monochrome copy, 50 sheets," "facsimile transmission, 20 sheets," and "color copy, 5 sheets," respectively. From "monochrome copy, 50 sheets" and "color copy, 5 sheets," table updating portion 256 recognizes that "toner unit" and "imaging unit" of "MFP1" operated 55 times, and updates the wearout degrees of "toner unit" and "imaging unit" of MFP wearout degree table 280 to values by adding "55".

Referring to FIG. 12, MFP wearout degree table 280 has a table structure including three records 280*a*, 280*b* and 280*c*, part by part. In records 280*a*, 280*b* and 280*c*, wearout degrees of units 1 to 3 of image forming apparatus MFP are stored. By way of example, units 1 to 3 correspond to "imaging unit," "tone unit," and "image reading unit."

Again referring to FIG. 7, when first determining portion 258 detects increase or decrease of the number of personal computers PC to which users are logged-in, based on the user log-in/log-off notice from user authentication portion 252, it determines whether change of power state of image forming apparatus MFP is necessary or not. More specifically, for each user who has logged-in to the personal computer PC, first determining portion 258 obtains the use history by referring to user use history table 278, and obtains accumulated log-in time by referring to log-in time management table 274. By dividing the use result by the accumulated log-in time, first determining portion 258 calculates expected demanded capacity for each user. Further, first determining portion 258 calculates total value of actual capacities of image forming apparatuses MFP that are powered ON by making a reference to MFP function table 282, and compares the calculated total value of actual capacities of image forming apparatuses MFP with the total value of expected demanded capacities. If the difference is the same as or higher than a prescribed threshold value, it is determined that power state of any of the image forming apparatuses MFP should be changed.

Referring to FIG. 13, MFP function table 282 has a table structure including four records 282*a*, 282*b*, 282*c* and 282*d*, for each of the image forming apparatuses MFP. Records 282*a*, 282*b*, 282*c* and 282*d* store actual capacities of functions 1 to 4 of image forming apparatuses MFP, respectively. Here, actual capacity typically represents processing ability per unit time.

For instance, actual capacities of functions 1 to 4 of "MFP1" are "40 sheets/min," "20 sheets/min," "15 sheets/min" and "50 sheets/min," respectively. Functions 1 to 4 of MFP function table 282 shown in FIG. 13 correspond to functions 1 to 4 of user use history table 278 of FIG. 11.

In the following, a process for determining whether power state of an image forming apparatus MFP must be changed or not if a user logs-in to or logs-off from a personal computer PC will be described.

First, for a function j of each image forming apparatus MFP shown in MFP function table 282, actual capacity will be denoted as $C_j$. Further, use result of function j by a user i shown in FIG. 11 will be denoted as $R_{ij}$, and accumulated log-in time of user i shown in FIG. 9 will be denoted as $T_i$. Then, the expected demanded capacity $D_{ij}$ of function j by user i will be given as:

$$\text{Expected demanded capacity } D_{ij}=\alpha\times R_{ij}/T_i$$

where α is a coefficient of load ratio equivalent, which is determined in consideration of the time period the user actually uses image forming apparatus MFP, of the log-in time.

If a new user logs-in or any of the users logs-off, first determining portion 258 makes a determination as to whether the difference between the total value $\Sigma D_{ij}$ of expected demanded capacities of logged-in users and the total value $\Sigma C_j$ of actual capacities of image forming apparatuses MFP which are currently powered-ON exceeds a corresponding threshold value or not. Specifically, first determining portion 258 determines that the power state of image forming apparatuses MFP should be changed if any of the following relations is satisfied.

$$|\Sigma C_1-\Sigma D_{i1}|>Th1$$

$$|\Sigma C_2-\Sigma D_{i2}|>Th2$$

$$|\Sigma C_3-\Sigma D_{i3}|>Th3$$

$$|\Sigma C_4-\Sigma D_{i4}|>Th4$$

Again referring to FIG. 7, first determining portion 258 identifies, based on power state information stored in MFP power state table 284, image forming apparatus or apparatuses MFP that are powered ON.

Referring to FIG. 14, MFP power state table 284 stores a value (power ON state or power OFF state) indicating power state of each MFP. Values of MFP power state table 284 are updated by a power state switching portion 262, which will be described later.

Again referring to FIG. 7, if first determining portion 258 determines that power state of image forming apparatus MFP should be changed, it notifies the result to second determining portion 260.

Receiving the notice from first determining portion 258, second determining portion 260 determines an image forming apparatus as the object of changing the power state. Specifically, it determines the object image forming apparatus MFP such that image forming apparatuses MFPs come to have balanced degrees of wearout, by making a reference to MFP wearout degree table 280.

Next, a process for determining the object image forming apparatus MFP if power change of an image forming apparatus MFP is necessary, will be described in detail.

First, if a new user logs-in or any of the users logs-off, second determining portion 260 calculates lacking or excessive capacity difference ΔC, based on the difference between the total value $\Sigma D_{ij}$ of expected demanded capacities of logged-in users and the total value $\Sigma C_j$ of actual capacities of image forming apparatuses MFPs that are currently powered ON.

$$\Delta C=|\Sigma C_1-\Sigma D_{i1}|+|\Sigma C_2-\Sigma D_{i2}|+|\Sigma C_3-\Sigma D_{i3}|+|\Sigma C_4-\Sigma D_{i4}|$$

Next, if it is the case that a user newly logs-in, second determining portion 260 successively extracts candidates from image forming apparatuses MFP that are currently powered OFF. Then, second determining portion 260 obtains actual capacity of the candidate by making a reference to MFP function table 282, and successively calculates deviation δ between the obtained each actual capacity and the capacity difference ΔC. In contrast, if it is the case that any of the users logs-off, second determining portion 260 successively extracts candidates from image forming apparatuses MFP that are currently powered ON. Then, second determining portion 260 obtains actual capacity of the candidate by making a reference to MFP function table 282, and successively calculates deviation δ between the obtained each actual capacity and the capacity difference ΔC, In either case, priority is given starting from one having the smallest calculated deviation δ between the actual capacity of image forming apparatus MFP and capacity difference ΔC. Specifically, when the actual capacity of a candidate image forming apparatus MFP is represented as C'j (j: function), the deviation δ will be given as:

$$\text{deviation } \delta=|\Delta C-(C'_1+C'_2+C'_3+C'_4)|$$

These processes are preformed to search for an image forming apparatus MFP having actual capacity closest to the difference (lacking capacity or excessive capacity) between the total capacity of image forming apparatuses MFP and the expected demanded capacities of all the users logged-in to the personal computers PC.

If only one candidate is extracted, second determining portion 260 determines the candidate image forming apparatus MFP as the object image forming apparatus MFP of which power state is to be changed.

In contrast, when there are a plurality of extracted candidates, second determining portion 260 obtains wearout degree of each candidate by making a reference to MFP wearout degree table 280. As described above, MFP wearout degree table 280 stores unit-by-unit wearout degree of each image forming apparatus MFP. Therefore, one-dimensional wearout degree W is calculated by multiplying the wearout degree $W_k$ of each unit k by a prescribed weight coefficient $\beta_k$, as will be described later. It is preferred that $\beta_1+\beta_2+\beta_3=100\%$.

$$W=\beta_1\times W_1+\beta_2\times W_2+\beta_3\times W_3$$

Then, second determining portion 260 determines whether wearout degree W of each candidate satisfies prescribed conditions or not. Typically, the prescribed conditions represent, when it is necessary to newly power-ON an image forming apparatus MFP as a user logs-on, that the wearout degree W is lower than a prescribed lower threshold value, and when it is necessary to power-OFF an image forming apparatus MFP as any of the users logs-off, that the wearout degree W is higher than a prescribed upper threshold value. Specifically, in a situation where any of the image forming apparatuses should be switched from power-OFF to power-ON, an apparatus having very low wearout degree is selected by priority, and in a situation where any of the image forming apparatuses should be switched from power-ON to power-OFF, an apparatus having very high wearout degree is selected by priority.

If none of the candidate image forming apparatuses MFP satisfies the prescribed conditions, second determining portion 260 again calculates priority among the candidates based on the degrees of wearout. Specifically, when a user logs-in, second determining portion 260 successively calculates an evaluation value δ' by multiplying deviation δ of each candidate by wearout degree W. On the contrary, when any user logs-off, second determining portion 260 successively calculates an evaluation value δ' by multiplying deviation δ of each candidate by an inverse of wearout degree W. In either case, priority is given starting from one having the smallest calculated value.

$$\delta' = \delta \times W \text{(when a user logs-in)}$$

$$\delta' = \delta \times 1/W \text{(when a user logs-off)}$$

Specifically, in a situation where any of the image forming apparatuses should be switched from power-OFF to power-ON, an apparatus having small deviation δ and low wearout degree W is selected by priority, and in a situation where any of the image forming apparatuses should be switched from power-ON to power-OFF, an apparatus having small deviation δ and high wearout degree W is selected by priority.

If the image forming apparatus MFP as the object of power state switching is determined, second determining portion 260 identifies the determined image forming apparatus MFP and outputs a state changing instruction to power state switching portion 262.

Power state switching portion 262 outputs a power ON instruction or a power OFF instruction to the object image forming apparatus MFP. Further, power state switching portion 262 updates contents of MFP power state table 284, in response to the switching of power state.

As to the correspondence between various functional blocks shown in FIG. 7 and the present invention, the detecting portion corresponds to the "user authentication portion 252, " the first determining portion corresponds to the "first determining portion 258, " the second determining portion corresponds to the "second determining portion 260, " the changing portion corresponds to the "power state switching portion 262, " and the wearout degree obtaining portion and the use history obtaining portion correspond to the "table updating portion 256."

Figure 15:
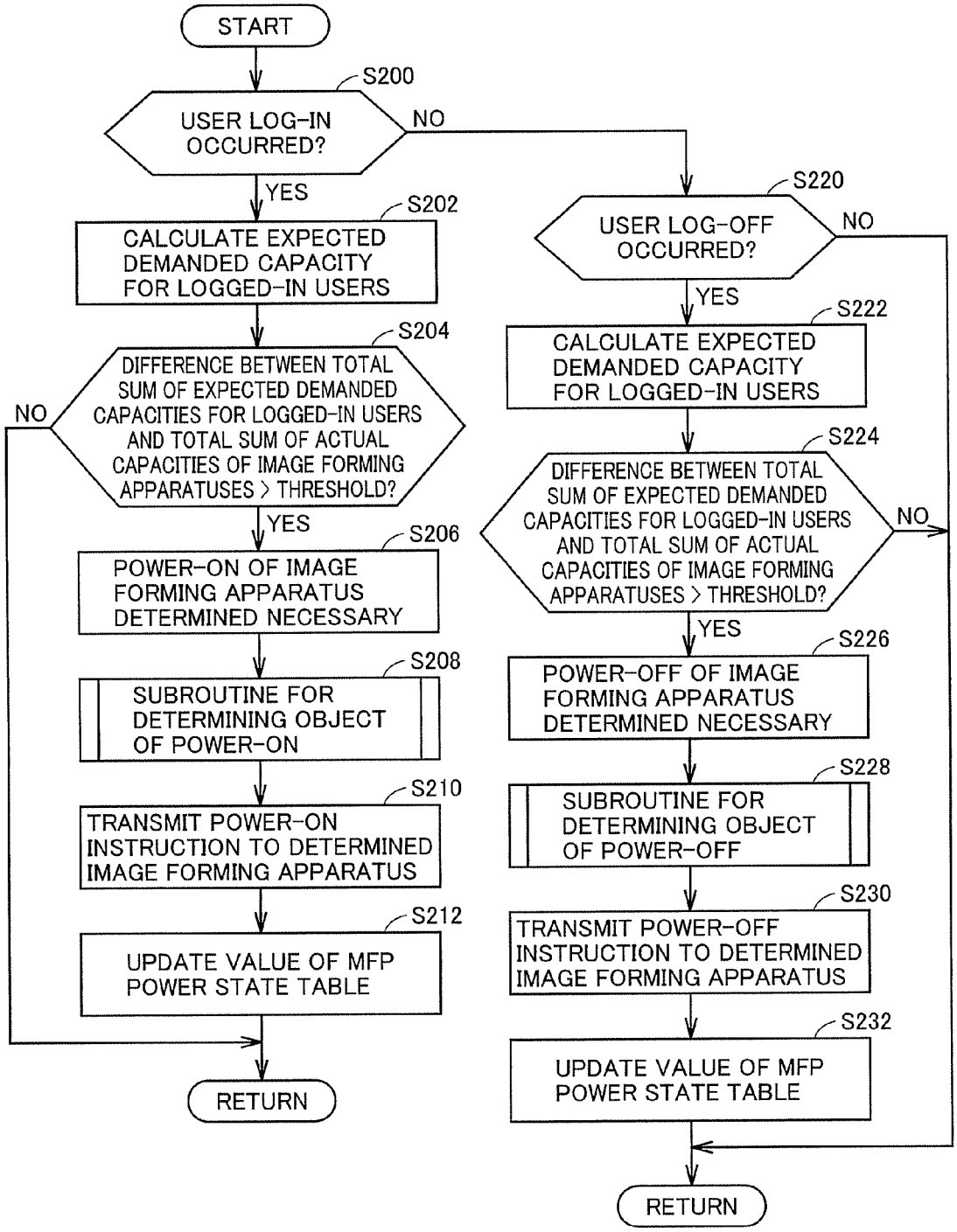
FIG. 15 is a flowchart representing process procedure related to power management of an image forming apparatus performed by the server in accordance with an embodiment of the present invention.

FIG. 15 represents process procedure related to the power management of image forming apparatuses MFP by the server SRV in accordance with the embodiment of the present invention. The process is realized by CPU 200 executing a program stored, for example, in hard disk portion 210.

Referring to FIG. 15, CPU 200 determines whether a user log-in to any personal computer PC has occurred or not (step S200). If a user log-in to a personal computer PC occurs (YES at step S200), CPU 200 calculates expected demanded capacities of all logged-in users, including the newly logged-in user (step S202). Thereafter, CPU 200 determines whether the difference, between the total value of expected demanded capacities of the users and the total value of actual capacities of image forming apparatuses MFP that are powered ON, exceeds the corresponding threshold value or not (step S204).

If the difference between the two exceeds the threshold value (YES at step S204), CPU 200 determines that any of the image forming apparatuses MFP that are powered OFF should be powered ON (step S206). Then, CPU 200 executes a subroutine for determining the image forming apparatus MFP as the object of power ON (step S208). To the image forming apparatus MFP determined by executing the subroutine, power state switching portion 262 transmits the power ON instruction (step S210), and updates the value of MFP power state table 284 (step S212). Then, the process returns to the start. In contrast, if the difference between the two does not exceed the threshold value (NO at step S204), CPU 200 determines that change of power state of image forming apparatuses MFP is unnecessary, and the process returns to the start.

If user log-in to any of the personal computers PC has not occurred (NO at step S200), CPU 200 determines whether user log-off from any of the personal computers PC has occurred or not (step S220). If a user log-off from a personal computer PC occurs (YES at step S220), CPU 200 calculates the expected demanded capacities of all logged-in users, except for the user who logged-off (step S222). Thereafter, CPU 200 determines whether the difference between the total value of expected demanded capacities of users and the total value of actual capacities of image forming apparatuses that are powered ON exceeds a corresponding threshold value or not (step S224).

If the difference between the two exceeds the corresponding threshold value (YES at step S224), CPU 200 determines that any of the image forming apparatuses MFP that are powered ON should be turned OFF (step S226). Then, CPU 200 executes the subroutine for determining the image forming apparatus MFP as the object of power OFF (step S228). To the image forming apparatus MFP determined by executing the subroutine, power state switching portion 262 transmits the power OFF instruction (step S230), and updates the value of MFP power state table 284 (step S232). Then, the process returns to the start. In contrast, if the difference between the two does not exceed the threshold value (NO at step S224), CPU 200 determines that change of power state of image forming apparatuses MFP is unnecessary, and the process returns to the start.

Figure 16:
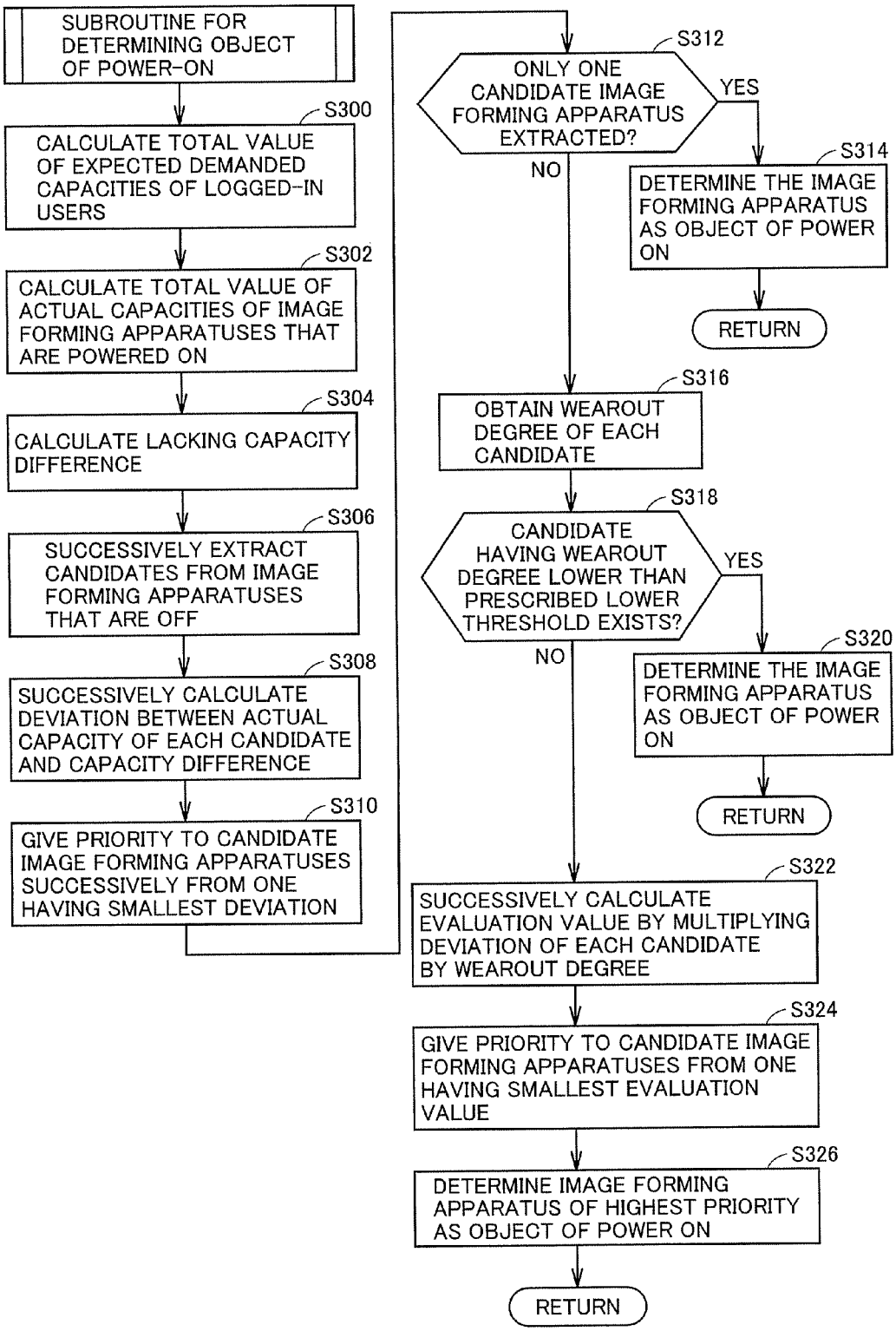
FIG. 16 is a flowchart representing a process procedure of a power-ON object determining subroutine shown in FIG. 15.

FIG. 16 shows the process procedure of the subroutine for determining the object of power ON, shown in FIG. 15.

Referring to FIG. 16, CPU 200 calculates the total value $\Sigma D_{ij}$ of expected demanded capacities of logged-in users (step S300), and calculates the total value $\Sigma C_j$ of actual capacities of image forming apparatuses MFP that are currently powered ON (step S302). Thereafter, CPU 200 calculates difference between the total value $\Sigma D_{ij}$ of expected demanded capacities and the total value $\Sigma C_j$ of actual capacities, to calculate lacking capacity difference ΔC (step S304).

Thereafter, CPU 200 successively extracts candidates from among the image forming apparatuses MFP that are currently powered OFF (step S306). Then, CPU 200 obtains actual capacity of each candidate by making a reference to MFP function table 282, and successively calculates deviation δ between the obtained each actual capacity and the capacity difference ΔC (step S308). Then, CPU 200 determines priority of candidate image forming apparatuses MFP, starting from one having the smallest deviation δ, among the successively calculated values (step S310).

Next, CPU 200 determines whether only one candidate image forming apparatus MFP has been extracted or not (step S312). If there is only one extracted candidate of image forming apparatus MFP (YES at step S312), CPU 200 determines the image forming apparatus MFP as the object image forming apparatus MFP of power ON (step S314). Then, the process returns to the flow of FIG. 15.

If a plurality of image forming apparatuses MFP are extracted as candidates (NO at step S312), CPU 200 obtains wearout degree of each candidate by making a reference to MFP wearout degree table 280 (step S316). Then, CPU 200 determines whether there is any candidate of which wearout degree is lower than a prescribed lower threshold value or not (step S318).

If there is any candidate having the wearout degree lower than the prescribed lower threshold value (YES at step S318), CPU 200 determines the image forming apparatus MFP as the object image forming apparatus MFP of power ON (step S320). Then, the process returns to the flow of FIG. 15. If there are a plurality of candidates having wearout degrees lower than the prescribed lower threshold value, the candidate having the lowest wearout degree is determined to be the object image forming apparatus MFP of power ON.

On the contrary, if there is no candidate having the wearout degree lower than the prescribed lower threshold (NO at step S318), CPU 200 successively calculates evaluation value δ' by multiplying the deviation δ of each candidate by the wearout degree W (step S322). Further, CPU 200 gives priority to candidate image forming apparatuses MFP, starting from the one having smallest evaluation value δ', among the successively calculated evaluation values δ' (step S324). Then, CPU 200 determines the candidate image forming apparatus MFP having the highest priority as the object image forming apparatus MFP of power ON (step S326). Then, the process returns to the flow shown in FIG. 15.

Figure 17:
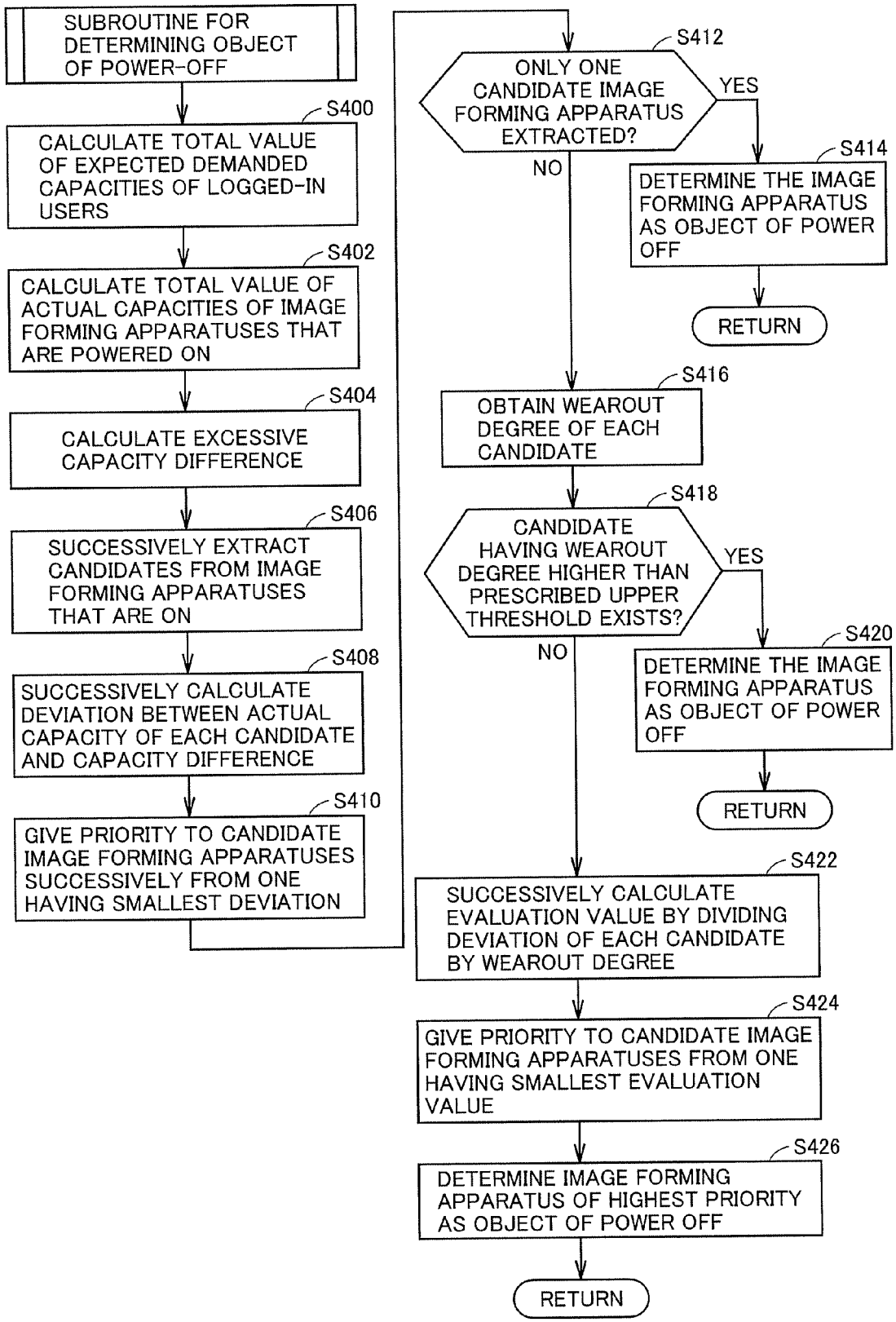
FIG. 17 is a flowchart representing a process procedure of a power-OFF object determining subroutine shown in FIG. 15.

FIG. 17 shows a process procedure of a subroutine for determining an object of power OFF, shown in FIG. 15.

Referring to FIG. 17, CPU 200 calculates the total value $\Sigma D_{ij}$ of expected demanded capacities of logged-in users (step S400), and calculates the total value $\Sigma C_j$ of actual capacities of image forming apparatuses MFP that are currently powered ON (step S402). Thereafter, CPU 200 calculates excessive capacity difference ΔC by calculating the difference between the total value $\Sigma D_{ij}$ of expected demanded capacities and the total value $\Sigma C_j$ of actual capacities (step S404).

Next, CPU 200 successively extracts candidates from image forming apparatuses that are currently powered ON (step S406). Then, CPU 200 obtains actual capacity of each candidate by making a reference to MFP function table 282, and successively calculates the deviation δ between the obtained each actual capacity and the capacity difference ΔC (step S408). Then, CPU 200 gives priority to candidate image forming apparatuses MFP, starting from the one having the smallest deviation δ from successively calculated deviations (step S410).

Next, CPU 200 determines whether only one candidate image forming apparatus MFP has been extracted or not (step S412). If there is only one extracted candidate of image forming apparatus MFP (YES at step S412), CPU 200 determines the image forming apparatus MFP as the object image forming apparatus MFP of power OFF (step S414). Then, the process returns to the flow of FIG. 15, If a plurality of image forming apparatuses MFP are extracted as candidates (NO at step S412), CPU 200 obtains wearout degree of each candidate by making a reference to MFP wearout degree table 280 (step S416). Then, CPU 200 determines whether there is any candidate of which wearout degree is higher than a prescribed upper threshold value or not (step S418).

If there is any candidate having the wearout degree higher than the prescribed upper threshold value (YES at step S418), CPU 200 determines the image forming apparatus MFP as the object image forming apparatus MFP of power OFF (step S420). Then, the process returns to the flow of FIG. 15. If there are a plurality of candidates having wearout degrees higher than the prescribed upper threshold value, the candidate having the highest wearout degree is determined to be the object image forming apparatus MFP of power OFF.

On the contrary, if there is no candidate having the wearout degree higher than the prescribed upper threshold (NO at step S418), CPU 200 successively calculates evaluation value δ' by dividing the deviation δ of each candidate by the wearout degree W (step S422). Further, CPU 200 gives priority to candidate image forming apparatuses MFP, starting from the one having smallest evaluation value δ', among the successively calculated evaluation values δ' (step S424). Then, CPU 200 determines the candidate image forming apparatus MFP having the highest priority as the object image forming apparatus MFP of power OFF (step S426). Then, the process returns to the flow shown in FIG. 15.

Power management of a plurality of image forming apparatuses MFP is executed in accordance with the process procedure described above.

According to the embodiment of the present invention, when a user logs in to a personal computer or a user logs off from a personal computer and a server determines that an image forming apparatus that has been powered OFF should be switched to power ON or an image forming apparatus that has been powered ON should be switched to power OFF, the image forming apparatus of which power state is to be changed is determined such that a group of image forming apparatuses come to have balanced degree of wearout. Further, whether power state of image forming apparatus must be changed or not is determined by comparing expected demanded capacities of users logged-in to personal computers and the actual capacities of image forming apparatuses that are powered ON.

Therefore, it becomes possible to maintain necessary and sufficient number of image forming apparatuses at power-ON state, thereby to efficiently reduce total power consumption and to efficiently maintain and manage the plurality of image forming apparatuses.

[Other Embodiments]

The program in accordance with the present invention may be realized by calling necessary modules in a prescribed sequence at prescribed timings to execute processes, from program modules provided as part of the operating system (OS) of a computer. In such a case, the program itself does not include the modules mentioned above, and the processes are executed in cooperation with the OS. Such program not including the modules is also encompassed by the present invention.

Further, the program in accordance with the present invention may be provided incorporated as a part of another program. In that case also, the program itself does not include the modules included in said another program, and the processes are executed in cooperation with said another program. Such a program incorporated in another program is also encompassed by the present invention.

The program product provided by the invention is executed installed in a program storage such as a hard disk. The program product includes the program itself and a storage medium storing the program.

Further, part of or all of the functions realized by the program in accordance with the present invention may be implemented by dedicated hardware.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A power management system for managing power of a plurality of image forming apparatuses, comprising:

a plurality of user terminals used by users of said plurality of image forming apparatuses;

a detecting portion for detecting increase or decrease of the number of user terminals that are being used among the plurality of user terminals;

a first determining portion for determining whether a change of power state of any of said image forming apparatuses is necessary or not, when the number of user terminals that are being used increased or decreased;

a second determining portion for determining an object image forming apparatus, when change of power state is determined to be necessary;

a changing portion for changing the power state of said object image forming apparatus; and a wearout degree obtaining portion for obtaining wearout degree of each of said image forming apparatuses, based on operation history of said plurality of image forming apparatuses; wherein said second determining portion determines said object image forming apparatus such that said plurality of image forming apparatuses come to have balanced wearout degree, based on said wearout degree, and said second determining portion includes a part for extracting candidate image forming apparatuses of which power state is to be changed, in response to increase or decrease of the number of user terminals that are being used, a part for determining as said object image forming apparatus, that one of said candidate image forming apparatuses of which wearout degree satisfies a prescribed condition, and a part for calculating, when none of said candidate image forming apparatuses has said wearout degree satisfying said prescribed condition, priority based on said wearout degree of each of the image forming apparatuses, and for determining the image forming apparatus having the highest priority to be said object forming apparatus.

2. The power management system according to claim 1, wherein said detecting portion identifies users using said plurality of user terminals;

said system further comprising a use history obtaining portion for obtaining user-by-user use history based on operation history of said plurality of image forming apparatuses; wherein said first determining portion includes a part for calculating expected demanded capacity based on said use history of users corresponding to said user terminals that are being used, and a part for comparing actual capacities of said image forming apparatuses that are powered on with said expected demanded capacity.

3. The power management system according to claim 1, wherein said wearout degree includes an index of at least one of an imaging unit, a toner unit and an image reading unit.

4. A power management method of managing power of a plurality of image forming apparatuses, comprising the steps of:

detecting increase or decrease of the number of user terminals that are being used, among a plurality of user terminals used by users of said plurality of image forming apparatuses;

determining, when the number of user terminal that are being used increased or decreased, whether change of power state of any of said image forming apparatuses is necessary or not;

when the change of power state is determined to be necessary, determining an object image forming apparatus;

changing the power state of said object image forming apparatus; and obtaining wearout degree of each image forming apparatus, based on operation history of said plurality of image forming apparatuses; wherein said determining the object image forming apparatus step includes the step steps of determining said object image forming apparatus such that said plurality of image forming apparatuses come to have balanced wearout degree, based on said wearout degree, extracting candidate image forming apparatuses of which power state is to be changed, in response to increase or decrease of the number of user terminals that are being used, determining that one of said candidate image forming apparatuses of which wearout degree satisfies a prescribed condition to be said object image forming apparatus, and calculating, when none of said candidate image forming apparatuses has said wearout degree satisfying said prescribed condition, priority based on said wearout degree of each of the image forming apparatuses, and determining the image forming apparatus having the highest priority to be said object image forming apparatus.

5. The power management method according to claim 4, wherein said detecting step includes the step of identifying users using said plurality of user terminals;

said method further comprising the step of obtaining user-by-user use history based on operation history of said plurality of image forming apparatuses; wherein the determining necessity of change of power state step includes the steps of calculating expected demanded capacity based on said use history of users corresponding to said user terminals that are being used, and comparing actual capacities of said image forming apparatuses that are powered on with said expected demanded capacity.

6. The power management method according to claim 4, wherein said wearout degree includes an index of at least one of an imaging unit, a toner unit and an image reading unit.

7. A non-transitory computer readable medium storing a power management program for causing a computer to perform power management of a plurality of image forming apparatuses, wherein said program causes said computer to execute the following steps of:

detecting increase or decrease of the number of user terminals that are being used, among a plurality of user terminals used by users of said plurality of image forming apparatuses;

determining, when the number of user terminals that are being used increased or decreased, whether change of power state of any of said image forming apparatuses is necessary or not;

when the change of power state is determined to be necessary, determining an object image forming apparatus;

changing the power state of said object image forming apparatus; and obtaining wearout degree of each image forming apparatus, based on operation history of said plurality of image forming apparatuses; wherein said determining the object image forming apparatus step includes the steps of determining said object image forming apparatus such that said plurality of image forming apparatuses come to have balanced wearout degree, based on said wearout degree, extracting candidate image forming apparatuses of which power state is to be changed, in response to increase or decrease of the number of user terminals that are being used, determining that one of said candidate image forming apparatuses of which wearout degree satisfies a prescribed condition to be said object image forming apparatus, and calculating, when none of said candidate image forming apparatuses has said wearout degree satisfying said prescribed condition, priority based on said wearout degree of each of the image forming apparatuses, and determining the image forming apparatus having the highest priority to be said object image forming apparatus.

8. The non-transitory computer readable medium storing power management program according to claim 7, wherein said detecting step includes the step of identifying users using said plurality of user terminals;

said program further causes said computer to execute the step of obtaining user-by-user use history based on operation history of said plurality of image forming apparatuses; wherein the determining necessity of change of power state step includes the steps of calculating expected demanded capacity based on said use history of users corresponding to said user terminals that are being used, and comparing actual capacities of said image forming apparatuses that are powered on and said expected demanded capacity.

9. The non-transitory computer readable medium storing power management program according to claim 7, wherein said wearout degree includes an index of at least one of an imaging unit, a toner unit and an image reading unit.

* * * * *